United States Patent [19]

Martinetz

[11] 3,955,382

[45] May 11, 1976

[54] DEVICE FOR CHANGING THREADS IN CIRCULAR KNITTING MACHINES

[75] Inventor: Johann Martinetz, Hechingen, Wurttemberg, Germany

[73] Assignee: Mayer & Cie., Tailfingen, Germany

[22] Filed: Apr. 20, 1973

[21] Appl. No.: 353,125

Related U.S. Application Data

[63] Continuation of Ser. No. 68,903, Sept. 2, 1970, abandoned.

[52] U.S. Cl. ..... 66/134; 66/138

[51] Int. Cl.[2] ..... D04B 15/60

[58] Field of Search ..... 66/138, 140 R, 154 A, 66/125 R, 133, 134

[56] References Cited

UNITED STATES PATENTS

| | | | |
|---|---|---|---|
| 778,164 | 12/1904 | Barratt | 66/140 R |
| 1,525,609 | 2/1925 | Howie et al. | 66/140 R |
| 2,072,969 | 3/1937 | Tandler | 66/154 A |
| 2,388,750 | 11/1945 | Lawson et al. | 66/140 R X |
| 2,543,121 | 2/1951 | Mishcon et al. | 66/138 |
| 3,274,802 | 9/1966 | Schmidt et al. | 66/138 |

FOREIGN PATENTS OR APPLICATIONS

| | | | |
|---|---|---|---|
| 601,122 | 8/1934 | Germany | 66/140 R |
| 825,445 | 12/1951 | Germany | 66/125 R |
| 1,328,400 | 4/1963 | France | 66/134 |
| 1,190,997 | 4/1959 | France | 66/125 R |
| 1,128,713 | 10/1968 | United Kingdom | 66/138 |

*Primary Examiner*—Wm. Carter Reynolds

[57] ABSTRACT

A device for changing threads in circular knitting machines, the device having several thread-changing units each of which is assigned to a knitting system of the circular knitting machine. The units have several thread-changing fingers for guiding various threads which can be selectively led to a knitting zone. The thread-changing units have members which include devices for cutting and clamping threads. In accordance with the invention, the thread-changing member of each thread-changing unit is connected with an electrically operated preselector, and is mechanically operated in dependence upon this preselector.

6 Claims, 5 Drawing Figures

INVENTOR:
Johann MARTINETZ

BY: Arthur O. Klein
Attorney for Applicant

INVENTOR:
Johann MARTINETZ

BY: Arthur O. Klein
Attorney for Applicant

INVENTOR.
Johann MARTINETZ

BY

Attorney for Applicant

DEVICE FOR CHANGING THREADS IN CIRCULAR KNITTING MACHINES

This is a continuation of application Ser. No. 68,903, filed Sept. 2, 1970, which is now abandoned.

This invention relates to a device for changing threads in circular knitting machines; usually each knitting machine is provided with a plurality of knitting systems, there being a plurality of thread-changing devices, each of which is assigned to a particular knitting system of the machine. In the illustrative embodiment of the invention, each thread-changing device has several units for changing threads for different threads, the different threads being selectively conducted to a knitting position or zone. The thread-changing units of the illustrative embodiment have thread-changing members each of which comprises a thread-insertion finger, a thread-clamping device, and a thread-cutting device which coact with an assigned thread.

Devices for changing threads in the above-indicated type of apparatus exist in various arrangements and are well-known. Such devices are sometimes called "striping attachments". These installations make it possible to supply the knitting spot or zone with various kinds of threads. Hitherto known thread-insertion devices have thread-insertion fingers which are not only operated mechanically, but are also selected mechanically. For example, in one such known installation, a preselector shifts a desired thread-changing finger of a thread-changing device by means of a Bowden wire. Additionally, thread cutting and clamping devices of the type indicated above are conventional and are described, e.g., in German Patent No. 601,122 (particularly FIGS. 6 and 7) and in German Patent No. 825,445 (particularly FIGS. 5 and 6).

Known devices for changing threads have a number of disadvantages, especially the disadvantage that the selection of the particular thread-changing units causes difficulties, and that most devices for changing threads select only a single thread-changing unit per shifting movement.

The present invention has among its objects the provision of a thread-changing device which is free from the disadvantages of the hitherto known thread-changing devices, and especially to create a device for changing threads which facilitates the selection of the single thread-changing units and enlarges the possibilities of their selection.

The above object is solved, in accordance with the invention, in the following manner: The thread-changing units of each thread-changing device are connected with an electrically operated preselector which is operated automatically in accordance with a programmer, the thread-changing units being mechanically operated in dependence upon the preselector. The preselector can be equipped with a known shifting system which is operated by means of a first cam rotating with the machine. The preselector consists of a perforated tape and a number of spaced apertures or hole tracks for cooperation with the perforations in the tape, the number of apertures corresponding to the maximum number of thread-changing fingers employed in the thread-changing unit. A plurality of first switches are mounted to cooperate with these apertures or hole tracks. The preselector also includes a plurality of shift or second switches corresponding in number to the number of the thread-changing units, the second switches being operated by means of a second cam rotating with the machine. The shift switches are placed consecutively into the track of the second cam, according to the order of the assigned units for changing threads. The preselector also has a plurality of preselecting members which correspond in number to the total number of the thread-changing fingers.

As preselecting members, electromagnets may be used, each electromagnet being assigned to a particular thread-changing finger. The electromagnets are selectively connected to any suitable source of operating current by means of a series connection of an individual selector switch with the appropriate exchange apparatus switch as well as with a main switch interposed between the current source and the control circuit. The electromagnets assigned to each thread-changing unit and acting as preselectors operate a latch which controls a switching wheel connected with a thread-insertion finger, a thread-clamping device, and a thread-cutting device of the thread-changing unit. All switching wheels of a thread-changing unit are operated by joint switching jacks the positions of which are determined by the position of particular electromagnetically-influenced latches, the switching jacks being actuated by a cam rotating behind the other two trigger cams. The switching wheels of the thread-changing unit are respectively connected with covering discs which coacts with the thread-inserting fingers, the thread-clamping devices, and the thread-cutting devices of the particular thread-changing unit by means of rocking levers. When the switching wheel is shifted and thus also the covering disc is shifted, first a thread switching-on movement is disconnected, because of the joint switching jacks, and then, with the next, or one of the next machine rotations the above-mentioned members of the thread-changing unit are disconnected in their switching-off movement, when the electromagnetically-influenced latch is released.

By means of a device for changing threads in accordance with the present invention, the thread-changing inserting and cutting mechanism of the individual units for changing threads can be prepared practically and in advance for the following operation demanded of them no matter in what relative position they are between the circulating or rotating and the stationary parts of the machine. There is a large possibility of choice of patterns and colors to be knitted and a shifting without periodicity of the particular thread-changing units is also possible. Each thread-insertion finger of the thread-changing units can be actuated alone or jointly, so that, in addition, several thread-insertion fingers can simultaneously be put into one or another position. Therefore, for example, an additional, reinforcing thread can be inserted into each or into only a few knitting spots or zones at any time, or a thread-changing finger can be switched-off when the machine is making marginal meshes without having to switch on another thread-changing finger of the same unit for changing threads.

Other characteristics and advantages of the device of the invention will be more readily apparent from the following description taken in connection with the drawings which somewhat schematically show an illustrative embodiment of a device for changing threads in accordance with the present invention. In the drawings.

Figure 1:
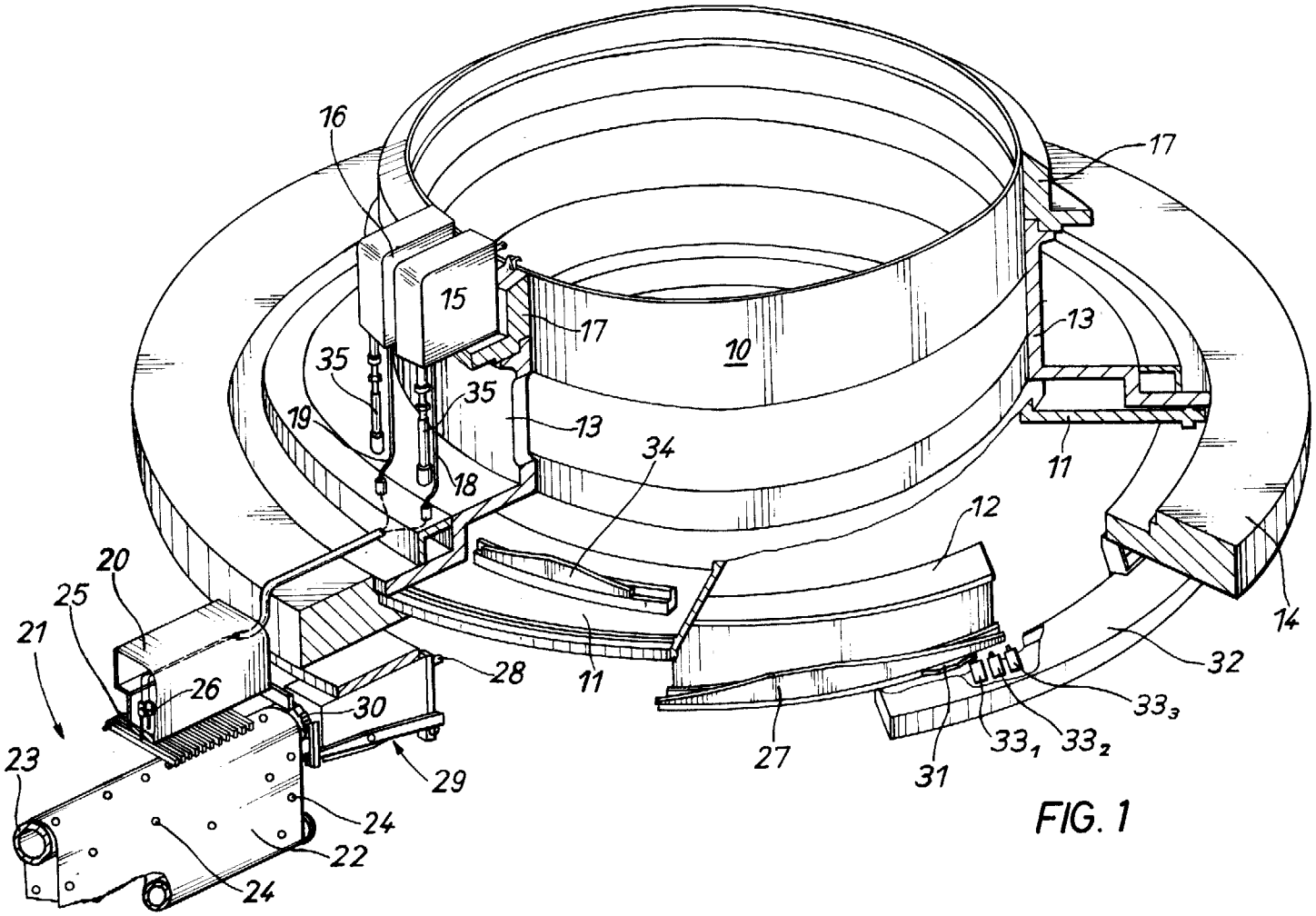
FIG. 1 is a fragmentary view in perspective of the needle cylinder and the rotating parts of a circular knitting machine as well as the cylinder lock jacket thereof, and arrangement of a device for changing threads in accordance with the invention being shown mounted upon the machine, certain of the parts being broken away for clarity of illustration.

Turning now to FIG. 1, there is shown a rotatable needle cylinder 10 which is provided with a lower ring flange 11 which rotates with the needle cylinder. On the bottom of the ring flange 11 there is another rotating ring body 12. The machine is provided with a stationary lock jacket 13 and a stationary supporting ring 14; the needles on the needle cylinder 10, and the cam or lock tracks on the jacket 13 for the various knitting systems of the knitting machine are not shown, since these parts are conventional.

For simplicity of illustration, only two thread-clamping units 15 and 16 are shown; each of units 15 and 16, which is assigned to a particular knitting system, is fixedly mounted upon an upper closing ring 17 of the non-rotatable lock jacket 13. The construction of units 15 and 16 is shown in detail in FIGS. 2–4, inclusive, which will be discussed hereinafter.

Each of units 15 and 16 includes several thread-clamping devices, which are connected with a controller 20 which is mounted upon the fixed supporting rings 14, such connection taking place by means of electric cables 18 and 19. The controller 20 is affixed to switching apparatus 21, which, as is known, has an endless perforated tape 22 which acts as a knitting program carrier. The tape 22 is stretched over a control drum 23 and has a number of rows of apertures or holes 24 therein disposed parallel to the length of the tape 22. The number of rows of such holes corresponds to the maximum number of the thread-changing fingers employed on the thread-changing units 15, 16. Each row of holes 24 is assigned to one of the selective fingers or pedals 25 of the controller 20. For simplicity of illustration, FIG. 1 shows only a part of the rows of holes 24 and only a part of the selective pedals or fingers 25 which are placed in a row one after another all over the perforated tape 22.

If the perforated tape 22 has a hole at the touching or contact-spot of the assigned selective pedal 25, a contact part of the selective pedal 25, not shown in the drawing, can drop into such hole. Thus the selective pedal 25 performs a swinging movement and an appropriate selective switch 26 is closed. Only two switches 26 are shown in FIG. 1 for clarity of illustration. The control drum 23, and with it the perforated tape 22, is shifted step-by-step in timed relationship with the rotation of the needle cylinder 10. This function is performed by a first trigger cam 27 which is affixed to ring body 12. The trigger cam 27 acts through a tripping pin 28 and lever arms 29, thereby controlling a jack-switch wheel 30 which is affixed to the control drum 23.

Ring body 12 also has a second trigger cam 31 which controls an exchange apparatus switch 33 fixedly mounted upon a stationary supporting ring 32. Each exchange apparatus switch $33_1$, $33_2$, etc. is assigned to a thread-changing unit 15, 16, etc. All exchange apparatus switches 33 are placed one after another and in accordance with their respective thread-changing units, into the track of the second trigger cam 31. A third trigger cam 34 is mounted upon the rotating ring flange 11 connected to the circulating needle cylinder 10, cam 34 cooperating with the switches 35 for the particular thread-changing units 15, 16, etc.

Figure 2:
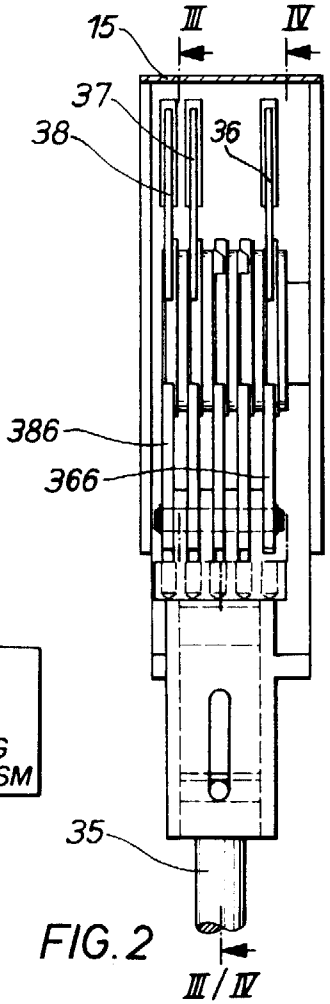
FIG. 2 is a view in rear elevation of a thread-changing device with several thread-changing units.
Figure 4:
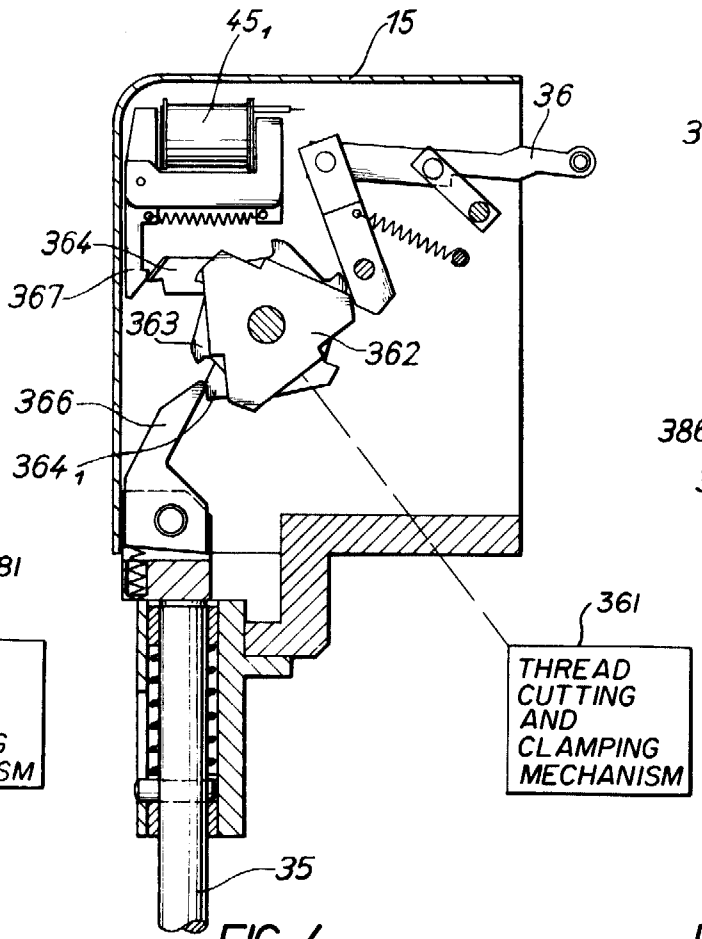
FIG. 4 is a view similar to FIG. 3 of the thread-changing device of FIG. 2, the section being taken along the line IV—IV in FIG. 2.
Figure 3:
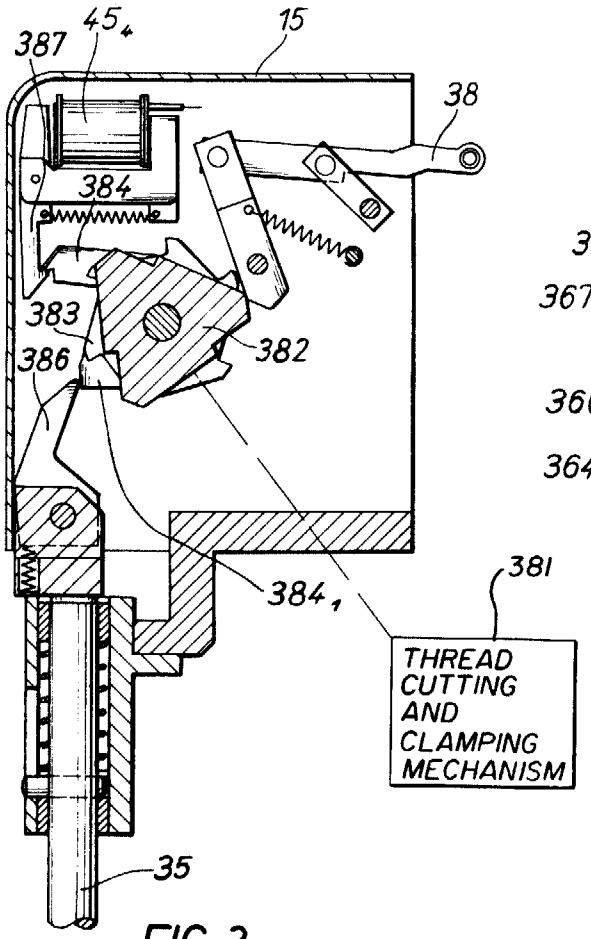
FIG. 3 is a view in vertical section through the thread-changing device of FIG. 2, the section being taken along the line III—III in FIG. 2.

In FIGS. 2, 3, and 4 there is shown a thread-changing unit 15 which is the same as all the other thread-changing units 16, etc. Thread-changing unit 15 is shown as having five thread-changing members, although only three thread-changing members with thread-depositing fingers 36, 37, and 38 are shown in FIG. 2. It is to be understood that the thread-changing units can have only a few thread-depositing fingers or can have more than five such fingers. Each of the thread-changing units has besides a thread-depositing finger such as 36, an operating means including a known mechanism for cutting and clamping threads 381 (FIG. 3) or 361 (FIG. 4). The working movements of the thread-depositing fingers and are effected by the portion of the operating means that includes a cam wheel 382 (FIG. 3) or 362 (FIG. 4) by way of an intermediate jack. Additionally, the working movements of the mechanisms 381 and 361 are respectively effected by wheels 382 and 362 in a conventional manner as described, e.g., in the above-mentioned German patents Nos. 601,122 and 825,445. Each cam wheel 362, 382 has an assigned ratched wheel 363 or 383 connected with it so that they rotate jointly. The marginal noses of the ratchet wheels 363 or 383 are covered by the covering discs $364_1$ or $384_1$ which are rigidly respectively affixed to pawls 364 or 384 so as to form a unitary construction therewith. The covering discs $364_1$ or $384_1$ are acted on by the electromagnets $45_1$ or $45_4$ via the pawl 364, 384. As will be described hereinbelow, the position of the electromagnets 45, which act as preselectors, determine whether or not the marginal noses of the switching wheels 366, 383 are covered or bluffed and the switching fingers 366, 386, respectively, can engage these marginal noses. The switching fingers 366, 388 are pivotally mounted and biased in a clockwise direction by a spring illustrated in FIGS. 3 and 4. Thus the fingers 366, 386 are urged against the ratchet wheel 363 or 383 unless they are bluffed by the covering wheel $364_1$, $384_1$. The covering discs $364_1$, $384_1$ rotate in a counterclockwise direction after the release of the pawls 364, 384, by the electromagnets 45, due to the center of gravity of the parts $364_1$, $384_1$, falling outside of the pivot point and also partially due to the spring pressure applied via the fingers 366, 386 which urge these fingers about their pivot point in a clockwise direction. All switching fingers 366, 386, etc., of the five thread-changing members of the thread-changing unit 15 are moved jointly up by the jack 35 when the third trigger cam 34 reaches the bottom of jack 35. When the switching jack 35 is pushed upwardly by the third trigger cam 34, all of the pawls 364, 384, are pushed upwardly by the jack 35 and are engaged and maintained in their upper position by the latch fingers 367, 387 until the associated electromagnet 45 is energized when a color change is to be carried out and pivots the associated latch finger 367, 387 to release the associated pawl 364, 384, whereupon the covering disc $364_1$, $384_1$ assumes again its lower position. The upward push of the lowered covering discs $364_1$, $384_1$ is effected via the fingers 366, 386 which are jointly pushed upwardly by the jack 35 and these fingers 366, 386 pass by the covering discs $364_1$, or $384_1$, and then engage the lowered one of the pawls 364, 384.

FIG. 3 illustrates a thread-depositing finger 38. This thread-depositing finger will not be shifted with the next upward movement of switching jack 35 and will remain in its position as the pawl 384 and covering or bluffing disc $384_1$, assigned to coact with its switching wheel 383, is retained by the latch finger $387_3$ of the appropriate electromagnet $45_4$. As can be seen in FIG. 3, the switching fingers 386 can not reach any marginal nose of the switching wheel 363, 383 when it is moved up.

On the other hand, the thread-changing unit with the thread-depositing finger 36, shown in FIG. 4, is operated when jack 35 is moved because this thread-changing unit has been preselected by energizing the assigned electromagnet $45_1$. The latch finger 367 has thereby released pawl 364 combined with covering disc $364_1$, thus exposing the marginal nose of switching wheel 363. Therefore, switching finger 366 strikes this marginal nose when it moves up and moves through or past the switching wheel 363 and the connected cam wheel 362. Therefore, the thread-depositing finger 36 with the thread running through it is shifted into the knitting range of the needles of the knitting machine and the mechanism for cutting and clamping threads 361 is operated so that it releases the clamped thread.

Figure 5:
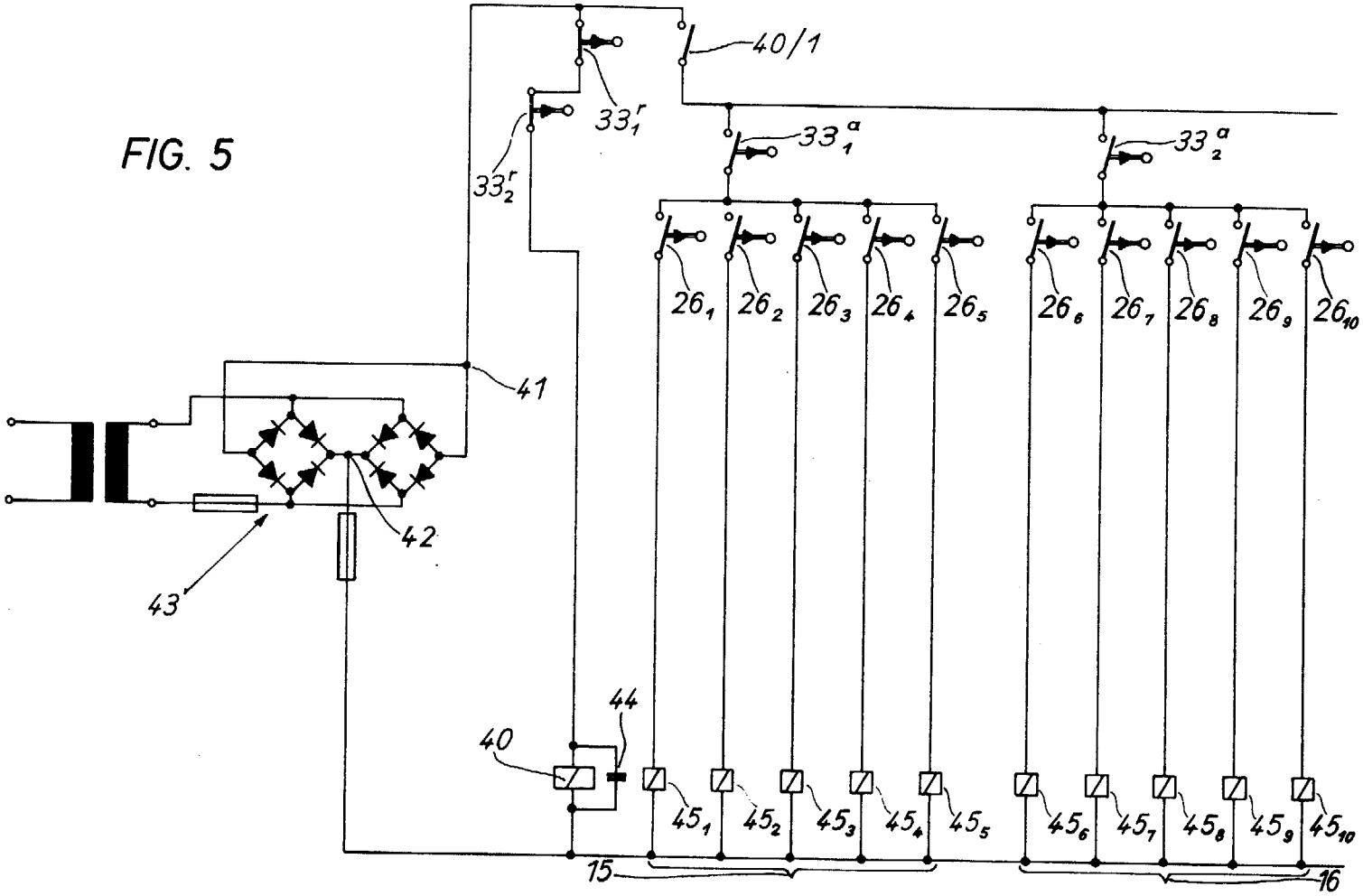
FIG. 5 is a diagram of the electrical control circuit for the illustrative embodiment of thread-changing device in accordance with the invention shown in FIGS. 1–4, inclusive.

The thread-changing device in accordance with the invention works as follows:

By means of the first trigger cam 27 the control drum 23 is progressively moved further with each rotation of the knitting cylinder 10, the control drum 23 carrying with it the perforated tape 22 which runs over the drum. Where there are holes in the perforated tape 22, assigned selective pedals or fingers 25 are shifted, and they operate selective switches 26. Each of the five thread-changing members of the units 15, 16, etc. for changing threads has a selective switch (FIG. 5) $26_1$ to $26_5$ or $26_6$ to $26_{10}$. As shown in FIG. 5, the switches $26_1$ and $26_5$, inclusive, are connected in parallel and in series with a switch $33_{1a}$, and the switches $26_6$ to $26_{10}$ are connected in parallel, and in series with a switch $33_{2a}$. Each selector switch $26_1$ to $26_{10}$ is connected to the respective electromagnet $45_1$ to $45_{10}$, such electromagnets acting as preselectors and each being assigned to a particular thread-changing unit. The exchange apparatus switches 33, which are operated one after the other by means of the second trigger cam 31 (FIG. 1), each have two position switches $33_r$ (stationary), and $33_a$, etc. Switches $33_{1r}$, $33_{2r}$, etc. of all switches 33 are connected in series with each other in the winding of a switching relay 40 which actuates the main switch 40/1, the series-connected switches $33_r$ and relay coil 40 being connected across the input terminals 41 and 42 of a direct current source 43. The switching relay 40 operates a main switch 40/1 which is interposed in a circuit from the input terminal 42 extending to the switches $33_{1a}$, and $33_{2a}$, etc. A condenser 44 is connected in shunt with the coil of the relay 40. When the device is turned on, the switching relay coil 40 is supplied with direct current from the source 43 over the normally closed contacts of the series-connected switches $33_{1r}$, $33_{2r}$, etc. Energization of the coil 40 of the relay closes the main switch contact 40/1. Energization of the coil 40 also results in the charging of the condenser 44. The perforated tape 22 determines which of the selective switches 26 is closed. As soon as the second trigger cam 31 strikes the particular exchange apparatus switches 33 and operates them, the switch $33_1$ assigned to the unit 15 is closed by means of the working contact $331^a$ of the exchange apparatus switch 33. Thus a current connection is established from the input terminal 41 over the main switch 40/1, the working contact $331^a$, and one or more switches 26 closed by the perforated tape, up to the terminal 42. The electromagnets 45 found in the particular current circuits which are energized are thus operated, and they select one changing thread unit assigned to them. The working electromagnets 45 thus release an assigned selecting wheel, and thus the pre-selected thread-changing finger of the particular thread-changing unit is put into action as soon as the third trigger cam 34 follows. In the embodiment shown, the exchange apparatus switches $33_{1r}$, $33_{2r}$, etc. are arranged as double switches with operative contacts $33a_1$, $33a_2$, etc. and inoperative or resting contacts $33^r$. With such arrangement, with each operation of an exchange apparatus switch 33 by means of the second trigger cam 31, the connection of switching relay 40 to the rectifying bridge 43 is interrupted. Nevertheless, the main switch 40/1 is not opened, because the activity of the switching relay 40 during the short operation of the exchange apparatus switches 33, and therefore the short energization interruption of the switching relay contact 40, remains as it was through the energy of the charging condenser 44. Should the trigger cam 31, however, remain still on one of the exchange apparatus switches 33, when turning-off the knitting machine, the main switch 40/1 is opened as soon as the stored energy of the charging condenser 44 is dissipated. Thus, a continuously energized condition of the electromagnets 45 during the inactivity of the knitting machine is avoided.

Although the invention is illustrated and described with reference to one preferred embodiment thereof, it is to be expressly understood that it is in no way limited to the disclosure of such a preferred embodiment, but is capable of numerous modifications within the spirit and scope of the appended claims.

What is claimed is:

1. In a circular knitting machine having a rotatable needle cylinder and a plurality of knitting systems, a plurality of thread-changing units each assigned to a knitting system of the machine and each comprising in combination a plurality of thread insertion fingers and a corresponding plurality of means individually associated with said insertion fingers for selectively operating the associated fingers, an electrically operated preselector for each operating means, switching apparatus including programming means having a programmed path for each operating means, the operating means of each thread-changing unit being actuated by one of said electrically operated preselectors when said programming means preselect the corresponding preselector and being mechanically operated in dependence upon said preselector, cam means on the cylinder adapted to coact with the preselector in accordance with the preselection carried out by said programming means, said knitting machine has a frame for rotatably supporting said needle cylinder, and said preselector coacts with said switching apparatus, said switching apparatus is operated by a first trigger cam of said cam means which rotates with the needle cylinder of the machine, exchange apparatus switches arranged on said frame in sequence and corresponding to the number of thread-changing units, and a second trigger cam of said cam means rotating with the needle cylinder of the machine for operating the exchange apparatus switches in sequence.

2. Apparatus for changing threads according to claim 1, wherein each of the preselectors comprises an electromagnet, one electromagnet being assigned to each respective operating means, the electromagnet assigned as a preselector to each operating means coacts with a pawl which in its turn controls a switching wheel of the said operating means, the switching wheel being operatively coupled with the thread insertion finger, wherein the switching wheel is connected with a covering disc which is coupled with the thread insertion finger in such manner that moving the switching wheel and thus the covering disc by means of a joint switch there is first performed an operative movement of the thread.

3. Apparatus for changing threads according to claim 1, wherein each of the preselectors comprises an electromagnet, one electromagnet being assigned to each respective operating means, a main switch in a control circuit of the thread-changing unit, a switching relay operating the main switch, and wherein the preselectors are connected by a series of individual selective switches, said exchange apparatus switches being arranged on said frame as double switches with one working contact each placed in series with the respective selective switch, each said double switch also having a resting contact which is connected in series with the switching relay operating the main switch.

4. Apparatus for changing threads according to claim 3, wherein the working contact and the resting contact of each exchange apparatus switch are operated simultaneously, and comprising a charging condenser connected in parallel with the switching relay which operates the main switch.

5. Apparatus for changing threads according to claim 1, wherein said programming means comprises an endless movable band which has a plurality of apertures defining said programmed paths.

6. Apparatus for changing threads according to claim 1, wherein each of the preselectors comprises an electromagnet, one electromagnet being assigned to each respective operating means, the electromagnet assigned as a preselector to each operating means coacts with a pawl which in its turn controls a switching wheel of the said operating means, the switching wheel being operatively coupled with the thread-insertion finger, wherein all switching wheels of a device for changing threads can be operated by means of a joint jack operated by a third trigger cam of said cam means, said third cam rotating with the first and second trigger cams in the same direction as the other two trigger cams, the third cam being placed behind the first and second cams, and in dependence upon the position of the respective electromagnetically controlled pawl.

* * * * *